United States Patent [19]

Kang

[11] Patent Number: 5,010,278

[45] Date of Patent: Apr. 23, 1991

[54] ELECTRONIC SWITCHING BALLAST FOR A FLUORESCENT LAMP

[75] Inventor: Sung H. Kang, Jinjoen-Meon, Rep. of Korea

[73] Assignee: Sung Ho Korea Company, Seoul, Rep. of Korea

[21] Appl. No.: 365,865

[22] Filed: Jun. 14, 1989

[51] Int. Cl.[5] ..... H05B 37/02

[52] U.S. Cl. ..... 315/224; 315/287; 315/307; 315/DIG. 7

[58] Field of Search ..... 315/287, 224, 307, 205, 315/DIG. 7

[56] References Cited

U.S. PATENT DOCUMENTS

| | | | |
|---|---|---|---|
| 4,039,897 | 8/1977 | Dragoset | 315/287 |
| 4,523,131 | 6/1985 | Zansky | 315/DIG. 7 |
| 4,651,060 | 3/1987 | Clark | 315/307 |
| 4,717,862 | 1/1988 | Anderson | 315/307 |
| 4,782,268 | 11/1988 | Fahnrich | 315/224 |

*Primary Examiner*—Eugene R. LaRoche
*Assistant Examiner*—Amir Zarabian
*Attorney, Agent, or Firm*—Finnegan, Henderson, Farabow, Garrett & Dunner

[57] ABSTRACT

An electronic switching ballast for fluorescent lamp having a rectifying circuit, a square generator, a phase discriminator, a switching time differentiating circuit and a wave shaping circuit. The alternating current input signal provided to the ballast is rectified by the rectifying circuit to a direct current signal. The square generator generates a square wave signal in reference to the direct current signal. The phase discriminator compares a feedback signal from the wave shaping circuit with a reference signal corresponding to the direct current signal to provide a full-wave rectified signal. The switching time differentiating circuit combines the square wave signal and full-wave rectified signal, and differentiates the combined signal to generate a pair of pulsed signals. The pulsed signals are out of phase with respect to one another. The wave shaping circuit provides a full-wave sinusoidal signal in reference to the pair of pulsed signals to an external circuit and feeds at least a portion of the signal back to the phase discriminator.

4 Claims, 3 Drawing Sheets

SQUARE-WAVE GENERATOR
SWITCHING TIME DIFFERENTIATING CIRCUIT
PHASE DISCRIMINATOR
FIRST DRIVER
SECOND DRIVER
AC INPUT
FUSE
TC
A
B
C
D
E
F
BD
C1
C2
C3
C4
C5
C6
C7
C8
C9
C10
D1
D2
D3
D4
D5
D6
D7
Q1
Q2
R1
R2
R3
R4
R5
R6
R7
R8
R9
T1
T2
T3
4
5
6
7
8

V
0
WP1
wt

V
0
WP2
wt

V
0
wt

V
0
wt

V
0
wt

V
0
wt

ELECTRONIC SWITCHING BALLAST FOR A FLUORESCENT LAMP

TECHNICAL BACKGROUND

The present invention concerns an electronic switching ballast circuit, wherein a part of the load supplying output voltage is fed back to arbitrarily limit the pulse width so as to modify the output into a sine wave.

Conventionally, a fluorescent lamp is lighted by using a choke transformer to cause a magnetic cathode preheating discharge. The drawbacks to this conventional method are that more than five seconds are needed for the lighting time, and a low frequency voltage of about 50 to 60 Hz resulting in faltering light is used, causing viewing problems and making it impossible to use this method at low voltages and low temperatures. Moreover, this conventional method results in frequency interferences with other electronic appliances, is likely to cause fire damage due to overload, and decreases durability of the lamp.

Recently, a low frequency oscillating electronic ballast using a choke transformer has been developed. Although this makes it possible to light the lamp instantly, the choke transformer consumes a large amount of power and uses low frequency causing the viewing problems due to faltering light.

SUMMARY OF THE INVENTION

It is an object of the present invention to provide an electronic switching ballast which makes it possible to instantly light the lamp even at low voltages and low temperatures, resolves the viewing problems by using high frequencies, and reduces the power consumption, in order to eliminate the drawbacks of the conventional magnetic cathode preheating method and the electronic cathode preheating method which uses low frequency oscillation.

It is another object of the present invention to provide an electronic switching ballast whereby a portion of the load supplying voltage is fed back to shape the output voltage into a sine wave by arbitrarily limiting the pulse width.

In the present invention, an electronic switching ballast for a fluorescent lamp comprises a rectifier, a constant-voltage regulator, a square-wave generator for generating a square-wave output voltage, a phase discriminator for full-wave rectifying of a feed-back voltage from a wave-shaping circuit by comparing it with a reference voltage, a switching time differentiating circuit for combining the output wave of said square-wave generator and the output wave of said phase discriminator to arbitrarily limit the pulse width, first and second drivers branched for each receiving the output of said switching time differentiating circuit, first and second output circuits for alternately operating in response to the outputs of said first and second drivers, and said wave-shaping circuit for modifying the outputs of said first and second output circuits into a sine wave.

The present invention will now be described with reference to the attached drawings provided only as examples.

BRIEF DESCRIPTION OF THE ATTACHED DRAWINGS

DETAILED DESCRIPTION OF THE PREFERRED EMBODIMENT

Figure 1:
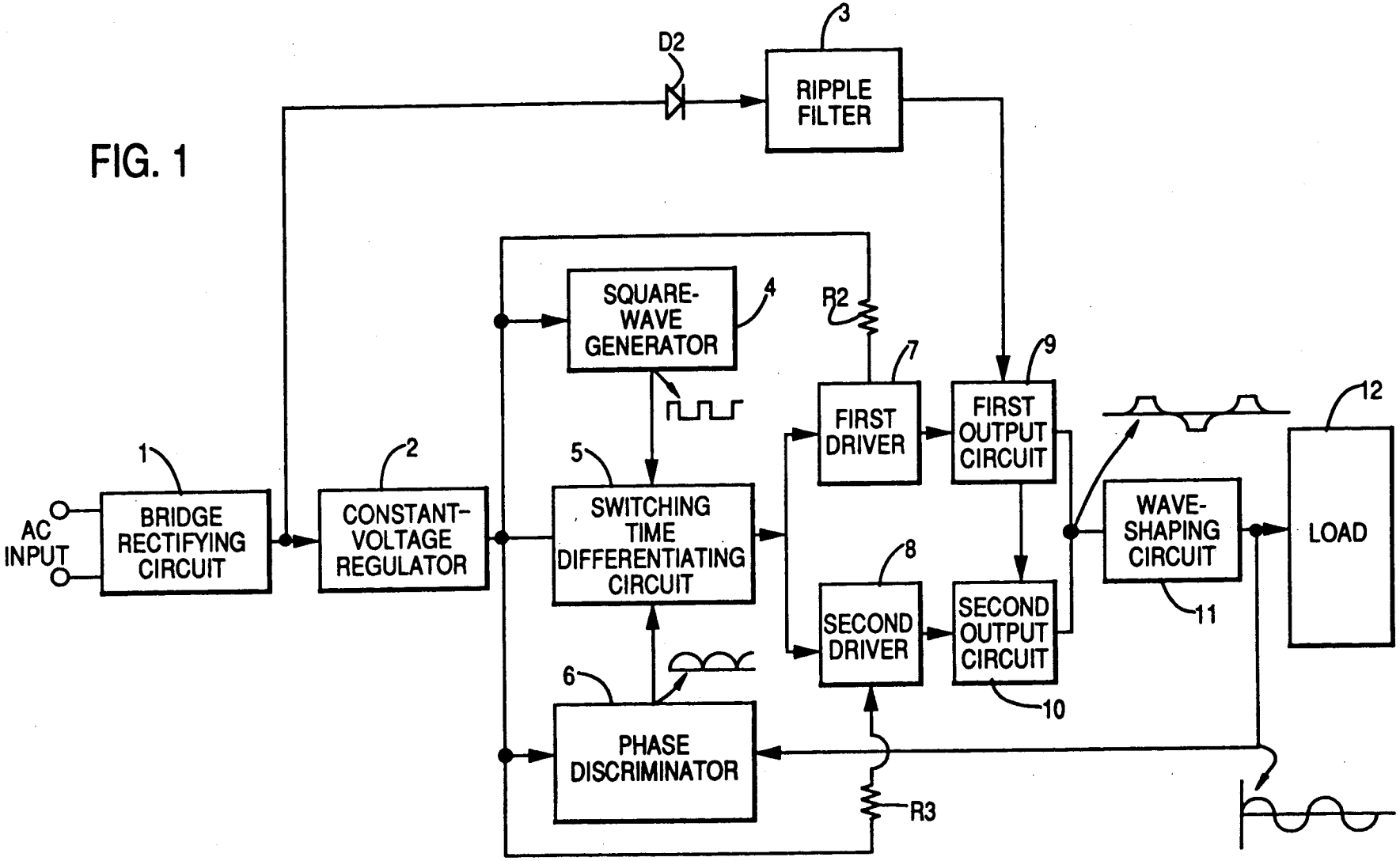
FIG. 1 is a block diagram for illustrating the innovative electronic switching ballast.

Referring to FIG. 1, an alternating current is applied to bridge rectifying circuit or rectifier 1 which rectifies the sine wave for constant-voltage regulator 2 to generate a constant direct voltage. This direct voltage is supplied to switching time differentiating circuit 5, square-wave generator 4 and phase discriminator 6. Additionally, the direct current is supplied through resistors R2 and R3 to first and second drivers 7 and 8.

The voltage rectified by bridge rectifying circuit 1 is smoothed in ripple filter 3 through the reversing current, preventing diode D2. The ripple filter 3 supplies the direct current to first and second output circuits 9 and 10, which outputs the currents to wave-shaping circuit 11.

The sine wave voltage generated by the wave-shaping circuit 11 is supplied to the load, while a portion of the voltage is fed back to the phase discriminator 6. The phase discriminator 6 full-wave rectifies the feed-back voltage by comparing it with a reference voltage, which is applied to the switching time differentiating circuit 5.

Additionally, the square-wave voltage generated by the square-wave generator 4 is applied to the switching time differentiating circuit 5, which combines the full-wave rectified voltage of the phase discriminator 6 and the square-wave of the square-wave generator 4 to differentiate the resultant wave by synchronizing it with a constant period. The switching time differentiating circuit 5 supplies two output voltages having the phase difference of 180° with each other, which voltages are supplied respectively to the first and the second drivers 7 and 8 functioning as buffers. The outputs of the two drivers are respectively applied to the first and second output circuits 9 and 10 for the wave-shaping circuit 11 to generate a constant sine wave of about 20 to 50 KHZ. The constant sine wave is applied to the load 12.

Figure 2:
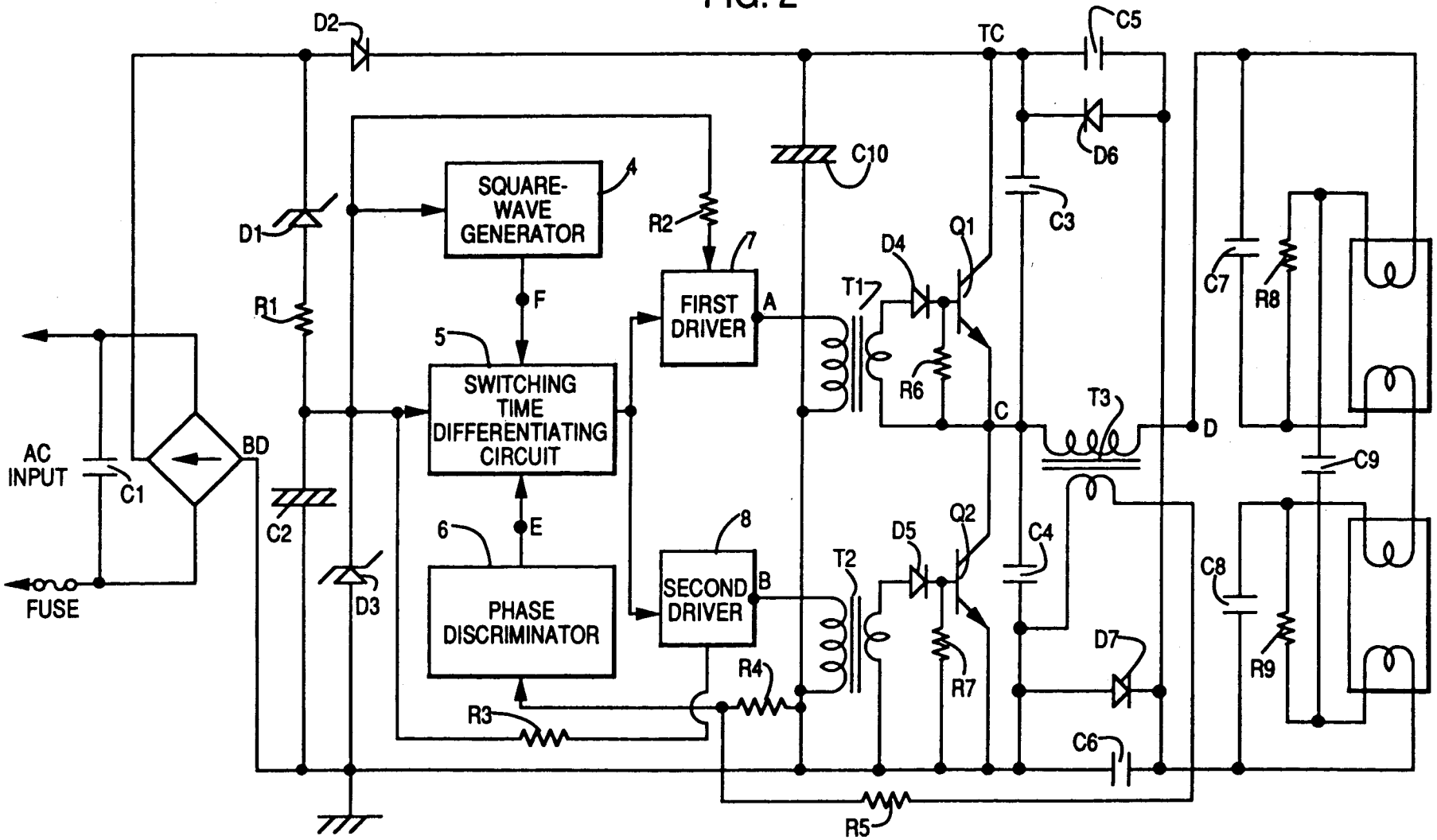
FIG. 2 is a detailed circuit diagram of the electronic switching ballast shown in FIG. 1.

Hereinafter, the operating principle of the present invention will be described with reference to FIG. 2.

Figures 3A, 3B, 3C, 3D, 3E, 3F:
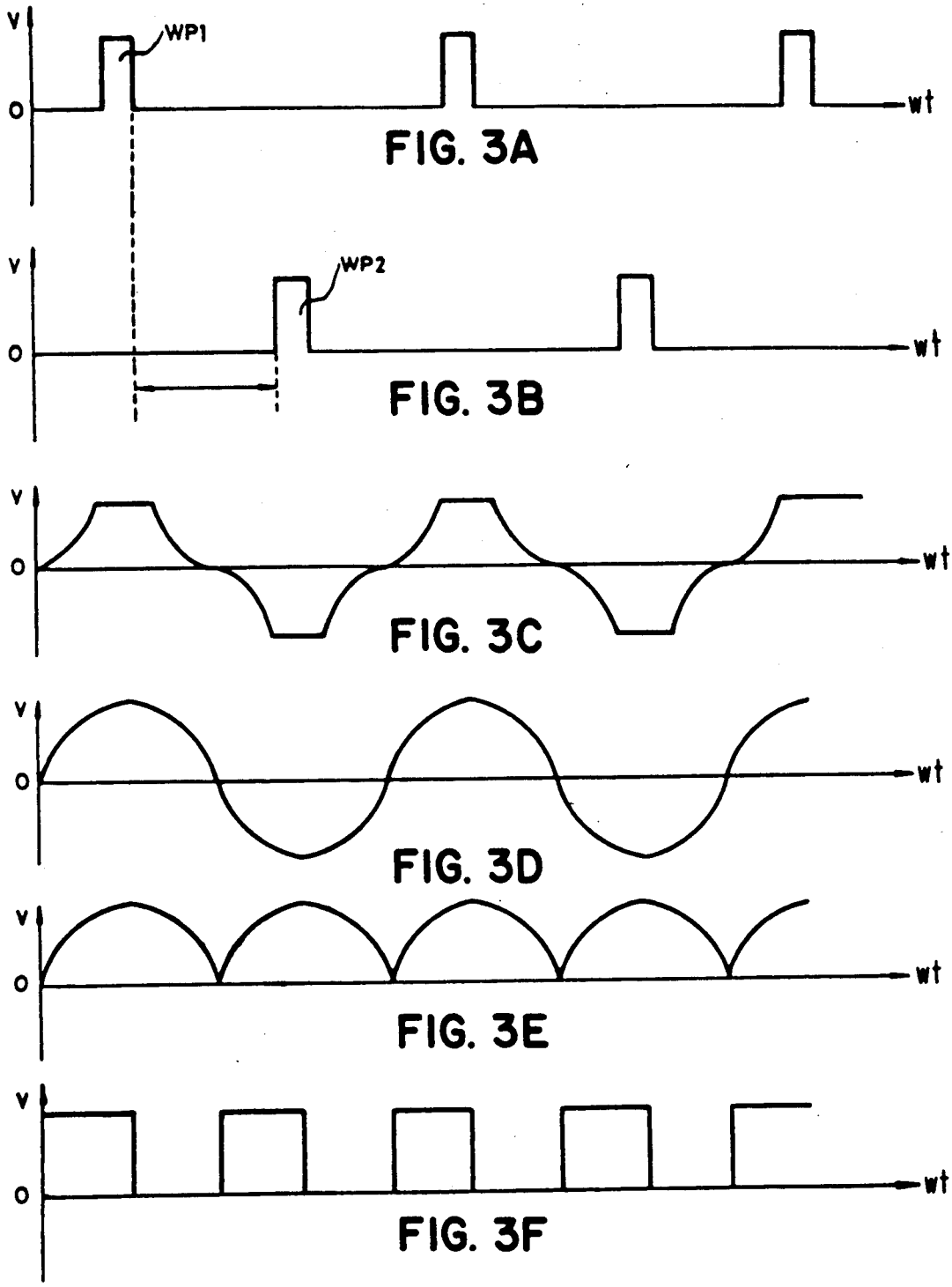
FIGS. 3A–3F illustrate the voltage waveforms for the essential parts of FIG. 2.

The alternating current applied to the input terminal is rectified by the bridge rectifying circuit 1 to form a sine wave. The rectified voltage, which is not a complete direct voltage, is fixed to about 20V through the zener diodes D1 and D3 and the resistor R1, and smoothed by capacitor C2 to form a complete direct voltage. This direct voltage is directly supplied to the square-wave generator 4, the switching time differentiating circuit 5, and the phase discriminator 6. The voltage is also supplied to the first and the second drivers 7 and 8 through the resistors R2 and R3. Besides, the voltage rectified by the bridge rectifying circuit 1 is smoothed by capacitor C10 through the reversing current preventing diode D2, and connected to the TC junction point. The output voltages of the first and second drivers 7 and 8 have the phase difference of 180°, whose waveforms are as shown in FIGS. 3A and 3B.

Thus, the two output voltages are applied to connecting transformers T1 and T2 respectively, whose induced voltages are respectively applied to the bases of transistors Q1 and Q2 through wave detecting diodes D4 and D5. If the pulse waveform WP1 as shown in FIG. 3A is applied to the base of the transistor Q1, the transistor Q1 is on and the transistor Q2 off. After a certain time Dt, if the pulse waveform WP2 as shown in FIG. 3B is applied to the base of the transistor Q2, the transistor Q2 is on and the transistor Q1 off. Hence, the transistors Q1 and Q2 are alternately on and off to produce at the junction point C an output waveform as shown in FIG. 3C. The output waveform of the junction point C is resonated by the capacitors C3 and C4 and the transformer T3 to produce a complete sine wave (for example, 20 KHZ–50 KHZ) at the point D in FIG. 2. The voltage of this sine wave is illustrated in FIG. 3D.

Meanwhile, a portion of the sine wave voltage produced at the point D is induced by the transformer T3, and fed back to the phase discriminator 6 through the resistor R5. By the feed-back voltage, the phase discriminator 6 produces the waveform as shown in FIG. 3E, which is applied to the switching time differentiating circuit 5 together with the square wave (e.g. 40-100 KHZ) generated by the square-wave generator 4. The voltage wave form of the square-wave generator 4 is illustrated in FIG. 3F. The switching time differentiating circuit 5 combines the wave form of FIG. 3E and the waveform of FIG. 3F to differentiate the resultant wave by synchronizing it with a constant period, so as to produce two output voltages having the phase difference of 180° with each other, which voltages are supplied respectively to the first and the second drivers 7 and 8 functioning as buffers.

Consequently, the voltage of the point D which is obtained by the resonating of the capacitors C3 and C4 and the transformer T3 preheats the cathode of the fluorescent tube and lights the tube through the capacitors C7, C8 and C9 and the resistors R8 and R9.

Thus, the inventive electronic switching ballast does not require the conventional start lamp and the choke transformer, saving 20–40% of the power consumption. Furthermore, the inventive ballast uses the high frequency of 20–50 KHZ, so that the viewing problems are resolved, the discharge can be obtained at low temperature (−30° C.), and the darkening phenomena near both electrodes of the lamp are not procuced. Additionally, the switching current loss of the switching transistors Q1 and Q2 is reduced, so that the rise in temperature is obstructed, and the frequency is kept stable.

What is claimed is:

1. An electronic switching ballast for fluorescent lamps, comprising:

rectifying circuit means for rectifying an alternating current input signal provided to the input of said ballast to a direct current signal;

square wave generator means, coupled to the rectifying circuit means, for providing a square wave signal in response to said direct current signal;

phase discriminator means, coupled to the rectifying circuit means, for comparing a feedback signal with a reference voltage in response to said direct current signal to provide a full-wave rectified signal;

switching time differentiating circuit means, coupled to the square wave generator and phase discriminator means, for combining said square wave signal and said full-wave rectified signal, and for providing a pair of pulsed signals in reference to said combined signals, said pair of pulsed signals being out of phase with respect to one another; and wave-shaping circuit means, coupled to the switching time differentiating circuit means, for providing a sinusoidal output signal in reference to said pair of pulsed signals to an external circuit, the output of said wave-shaping circuit means being coupled to the input of said phase discriminator means to feed back at least portion of said sinusoidal output signal to the phase discriminator means.

2. The electronic switching ballast of claim 1, wherein said switching time differentiating circuit means includes first driver means for providing a first of said pair of pulsed signals, and second driver means for providing a second of said pair of pulsed signals.

3. The electronic switching ballast of claim 1, wherein said pair of pulsed signals are 180° out of phase with respect to one another.

4. The electronic switching ballast of claim 2, wherein said wave-shaping circuit means includes first output circuit means coupled to the first driver means for providing a first signal in reference to said first pulsed signal, and second output circuit means coupled to the second driver means for providing a second signal in reference to said second pulsed signal, said first and second signals being combined to constitute said sinusoidal output signal.

* * * * *